US011015332B2

(12) United States Patent
Ustinov

(10) Patent No.: US 11,015,332 B2
(45) Date of Patent: May 25, 2021

(54) CONSTRUCTION SYSTEM FOR BUILDING A MODULE OF A DWELLING

(71) Applicants: Jihan Ustinov, Laussane (CH); Igor Ustinov, Laussane (CH); André Hoffmann, Vaux-sur-Morges (CH)

(72) Inventor: Igor Ustinov, Lausanne (CH)

(73) Assignee: UHCS PROPERTY SA

( * ) Notice: Subject to any disclaimer, the term of this patent is extended or adjusted under 35 U.S.C. 154(b) by 0 days.

(21) Appl. No.: 16/483,776

(22) PCT Filed: Dec. 21, 2017

(86) PCT No.: PCT/IB2017/058262
§ 371 (c)(1),
(2) Date: Aug. 6, 2019

(87) PCT Pub. No.: WO2018/146533
PCT Pub. Date: Aug. 16, 2018

(65) Prior Publication Data

US 2020/0002935 A1 Jan. 2, 2020

(30) Foreign Application Priority Data

Feb. 13, 2017 (CH) ..... 00164/17

(51) Int. Cl.
*E04B 1/28* (2006.01)
*E04B 2/14* (2006.01)
(Continued)

(52) U.S. Cl.
CPC ..... *E04B 1/28* (2013.01); *E04B 1/34315* (2013.01); *E04B 1/58* (2013.01); *E04B 2/14* (2013.01);
(Continued)

(58) Field of Classification Search
CPC ..... E04B 1/28; E04B 1/34315; E04B 1/58; E04B 2/14; E04B 2/562; E04B 2001/2433; E04B 2002/567
(Continued)

(56) References Cited

U.S. PATENT DOCUMENTS 2,689,473 A * 9/1954 Voss ..... E04B 2/56 52/422
4,584,801 A * 4/1986 Weinberger ..... E04B 1/34315 403/171
(Continued)

FOREIGN PATENT DOCUMENTS

DE 2606353 8/1977
DE 202010002699 6/2010

*Primary Examiner* — Paola Agudelo
(74) *Attorney, Agent, or Firm* — Galbreath Law Offices, P.C.; John A. Galbreath

(57) ABSTRACT

A construction system for a module of a dwelling the main elements of which are made of plastic material includes a set of hollow profiled beams (1, 1') of elongate rectilinear shape of type 1 and of type 2. The beams (1, 1') include at each end (5, 5') a transverse passage opening (6, 6'). The transverse passage opening (6) of a beam (1) of type 1 comes to be nested with the transverse passage opening (6') of a beam (1') of type 2 when the two beams (1, 1') are assembled end to end at a right angle leaving a passage opening (6, 6') between the two ends (5, 5') of the beams (1, 1'). Two beams (1) of type 1 can be assembled with two beams (1') of type 2 to form a rectangular frame. The system further includes a set of corner assembly elements (2, 2'), each assembly element (2, 2') including a body intended to pass through the transverse passage opening (6, 6') of the beams (1, 1') of type 1 and 2. The system also includes a set of plates (3) that can be assembled between two beams (1) of type 1 when assembled or two beams (1') of type 2 when assembled to form a rectangular frame, and a set of posts (11) of hollow
(Continued)

rectangular section the hollow ends of which come to be nested over a corner assembly element (2, 2') of a rectangular frame formed of beams (1, 1') of type 1 and of type 2 so as to form a three-dimensional framework. The posts (11) include longitudinal rails or grooves (8) on two adjacent surfaces to receive other plates (3') between the posts (11) during assembly. Each hollow profile beam (1, 1') including along an upper surface spaced rails or grooves (8) intended to receive said other plates (3').

17 Claims, 12 Drawing Sheets

(51) Int. Cl.

| | |
|---|---|
| ***E04B 1/343*** | (2006.01) |
| *E04B 1/58* | (2006.01) |
| *E04B 2/56* | (2006.01) |
| *E04B 1/24* | (2006.01) |

(52) U.S. Cl.
CPC ..... *E04B 2/562* (2013.01); *E04B 2001/2433* (2013.01); *E04B 2002/567* (2013.01)

(58) Field of Classification Search
USPC ..... 52/653.1, 422
See application file for complete search history.

(56) References Cited

U.S. PATENT DOCUMENTS

| | | | | |
|---|---|---|---|---|
| 4,910,932 | A * | 3/1990 | Honigman | E04B 1/08 52/280 |
| 5,065,558 | A * | 11/1991 | Boatsman | E04B 1/34315 52/239 |
| 5,813,174 | A * | 9/1998 | Waller | E04B 1/34315 109/78 |
| 8,292,380 | B2 * | 10/2012 | Fan | H05K 7/183 312/265.4 |
| 2007/0261356 | A1 * | 11/2007 | Vaughn | E04B 1/24 52/655.1 |
| 2010/0077683 | A1 * | 4/2010 | Lyons | E04B 1/34315 52/274 |
| 2012/0012543 | A1 * | 1/2012 | Fan | H05K 7/1488 211/26 |
| 2015/0159363 | A1 * | 6/2015 | Ehsasi | E04H 1/06 52/79.5 |
| 2015/0308095 | A1 * | 10/2015 | O'Neal | E04B 1/34326 52/653.2 |
| 2018/0155920 | A1 * | 6/2018 | Ovrum | E04B 1/2403 |

* cited by examiner

CONSTRUCTION SYSTEM FOR BUILDING A MODULE OF A DWELLING

The present invention relates to a construction system for a module of a dwelling the main elements of which are made of plastic material.

Already known in the prior art is product packaging for creating assemblies essentially of plastic material. WO0212077 describes a molded plastic material bottle including connection means so that the bottle may be connected side by side to another bottle by connecting means such as dovetails for example. The bottles may also be assembled together, so enabling the production of assemblies of bottles.

Also known is WO2012045061 which describes devices and containers that are extensible, modular, and able to be locked laterally and vertically with other similar containers for a whole variety of applications.

Also known are persons who have undertaken and completed constructions such as houses based on plastic bottles and most of the time the bottles are placed horizontally.

Traditional construction systems, based on bricks for example, are also known and very widespread, but the cost of a construction nevertheless remains high.

Moreover, the applicant has filed a patent application, number CH707115, for a bottle that can be assembled with others with the aim of producing a construction. These bottles have a shape with a frustoconical male/female part.

The applicant has also filed another patent application, number CH708086, for a bottle including in its upper part a double male cylindrical neck including first mechanical coupling means that can be actuated by rotation. The lower part of the bottle includes a double cylindrical neck including second mechanical coupling means that can be actuated by rotation and are complementary to said first mechanical actuation means. The upper part of a bottle can be coupled into the lower part of another bottle by the two-fold action of the male and female necks in order to bring into contact the respective bearing surfaces. The bottle has at its periphery at least one longitudinal female opening enabling insertion of an intermediate rod, said rod serving as a connection between two bottles disposed one beside the other or a bottle and another construction element with a longitudinal female opening.

The above two patent applications are based on assembling bottles of particular shape in order to produce a rigid structure where applicable with increased rigidity and an improved seal.

WO2016016706 describes a construction system including a set of accessory elements and a set of bodies of elongate shape intended to produce a construction by assembling a plurality of said bodies with accessory elements. The body of elongate shape includes a front face and a rear face, which are plane and opposite, an upper face and a lower face, which are plane and opposite, and two opposite lateral faces. At least one of said two lateral faces has a recessed part, in particular an incurvation on its central part. Each body is assembled with another body with their lateral faces between them and/or by assembling a lower face of one body to the upper face of another body and/or by assembling a lateral face of one body with the front or rear face of another body. The accessory elements are elongate parts that come to be inserted between and in contact with the recessed parts of the two elongate bodies when assembled face to face and extend over all or a substantial part of the height of the elongate bodies. The elongate parts define, alone in the case of hollow elongate parts or by cooperation of these elongate parts with facing recessed parts of the elongate bodies, a central space situated between and in the middle of the recessed parts of the elongate bodies. The elongate bodies further define lateral spaces between the lateral faces of the recessed parts of the elongate bodies on either side of the elongate parts.

Also known are construction systems consisting of plastic material parts although they are intended for the construction of scale models.

The present invention enables production of a construction system for a module of a dwelling the main elements of which are made of plastic material, in particular recycled plastic material, providing a robust construction in a very simple and very rapid manner.

According to the invention, this aim is achieved thanks to a construction system for a module of a dwelling the main elements of which are made of plastic material, the construction system including:

- a set of hollow profiled beams of elongate rectilinear shape of type 1 and of type 2, the beams including at each end a transverse passage opening such that the transverse passage opening of a beam of type 1 comes to be nested with the transverse passage opening of a beam of type 2 when the two beams are assembled end to end at a right angle leaving a passage opening between the two ends of the beams so that two beams of type 1 can be assembled with two beams of type 2 to form a rectangular frame,
- a set of corner assembly elements, each assembly element including a body intended to pass through the transverse passage opening of the beams of type 1 and 2,
- a set of plates that can be assembled between two beams of type 1 when assembled or two beams of type 2 when assembled to form a rectangular frame, and
- a set of posts of hollow rectangular section the hollow ends of which come to be nested over a corner assembly element of a rectangular frame formed of beams of type 1 and of type 2 so as to form a three-dimensional framework.

The posts include longitudinal rails or grooves on two adjacent surfaces to receive other plates between the posts during assembly.

Each hollow profiled beam including along an upper surface spaced rails or grooves intended to receive said other plates.

In one embodiment, the beams of type 1 have a closed square section and the beams of type 2 have a U-shape section intended to receive said plates.

In one embodiment, each construction module is able to be assembled with another module, each module measuring between 2.5 m and 3.5 m side length and between 2.2 m and 2.8 m high.

In a preferred embodiment, the plates and the other plates include extractable zones for creating openings.

In one embodiment, the plates are adapted to slide in the beams of type 2 and between the grooves or the rails of the beams of type 1 and the posts.

For improved thermal and acoustic insulation of the dwelling modules, the other plates include compartments for insulation elements and the plates include a housing on one of the wide faces for insulation elements, the housing being closable by a sealed cover.

To withstand greater loads, the beams include at each end a removable part made of a more rigid material than the beams, for example of metal.

For ecological reasons the construction system is preferably made from so recycled plastic materials.

For greater rigidity, each beam and each plate is filled with a substance intended to harden its structure, for example soil mixed with a hardening resin, cement, concrete, loam or any other hardening substance, or even a porous material such as a rigid foam.

In accordance with the present invention it is possible to produce an assembly of a habitation module constructed from a construction system including a three-dimensional framework assembled from beams of type 1 and type 2 forming horizontal rectangular frames and vertical posts assembled to the corners of the rectangular frames, horizontal plates between the beams of type 1 and type 2, and other, vertical plates between the posts and superposed on the profiled beams.

According to this embodiment, when the corner assembly elements are fixed to the ground, a second construction module may be coupled to a first module, the other plates common to the two modules optionally being fitted.

For a more robust assembly, each beam has a removable metal end.

In a preferred embodiment, the upper part of the module of a dwelling is sealed either by mounting plates or by positioning a covering to which may be applied a polymerizing resin rendering said covering rigid and impermeable.

Thanks to this assembly, it is possible to produce an element of a dwelling, among others, a garage, a house.

The features of the invention will become more clearly apparent on reading the following description of a plurality of embodiments provided by way of nonlimiting example only with reference to the diagrammatic figures, in which.

Figure 3:
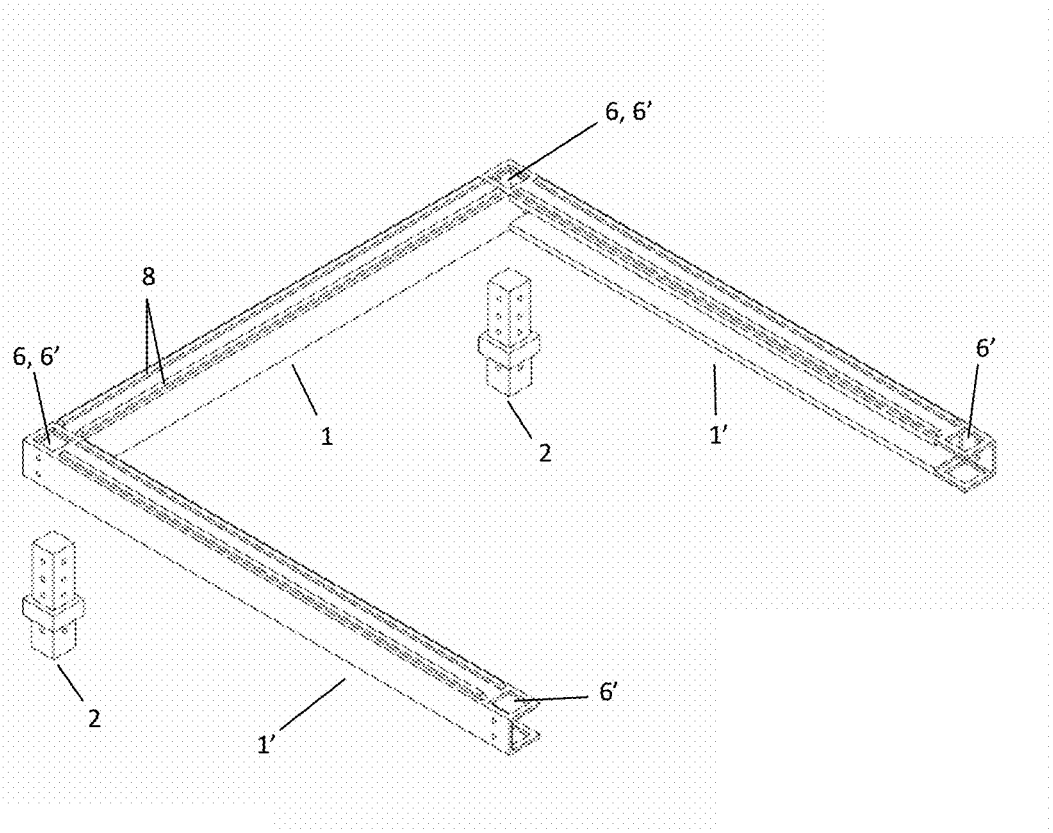
Figure 4:
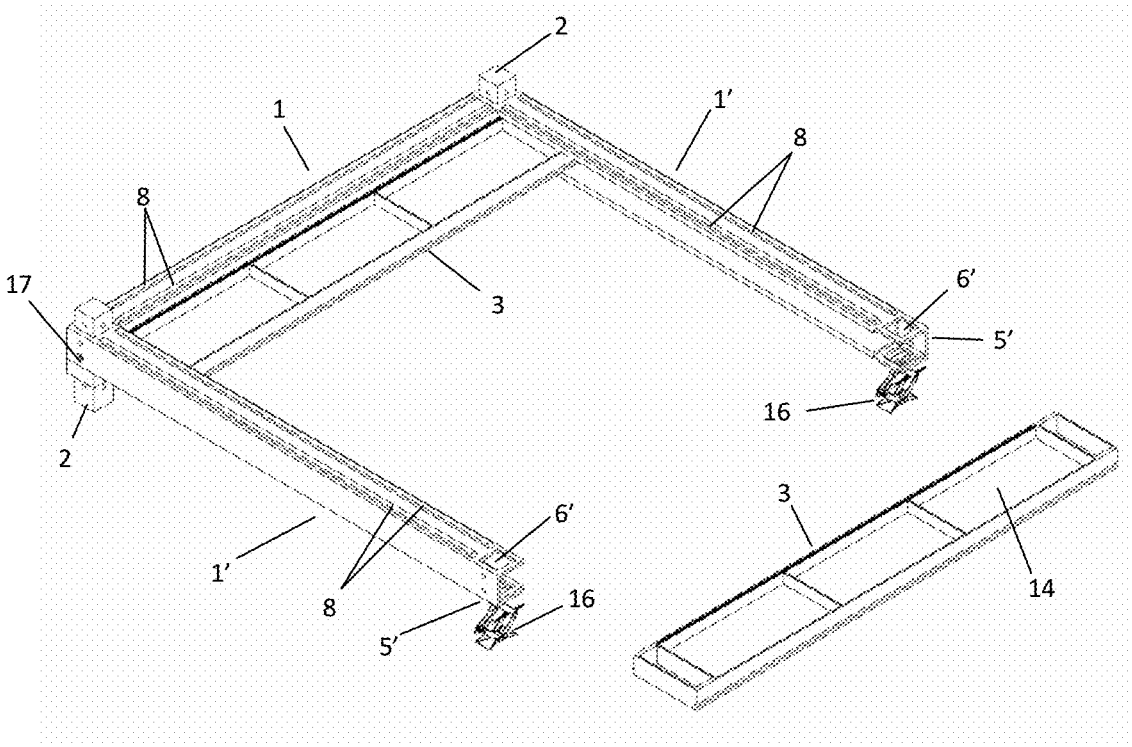
Figure 5:
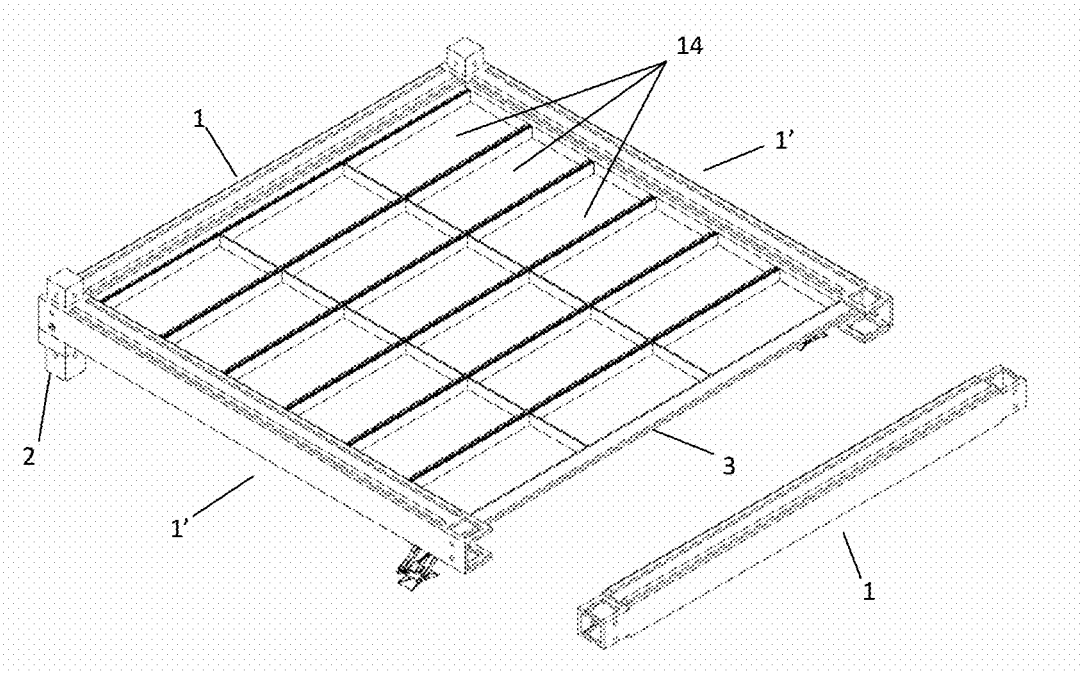
Figure 7:
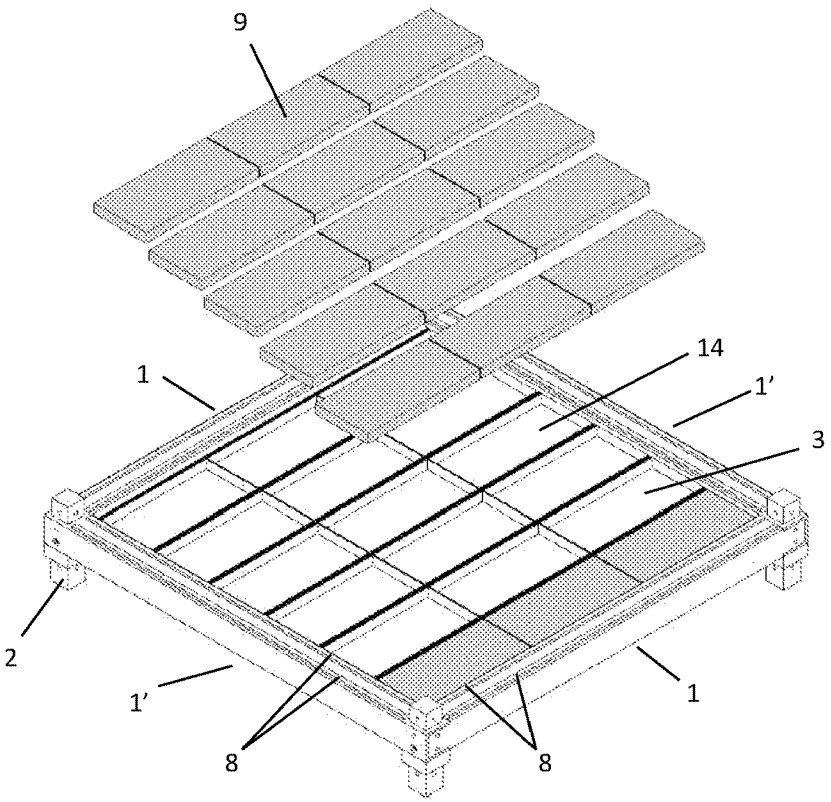
Figure 6:
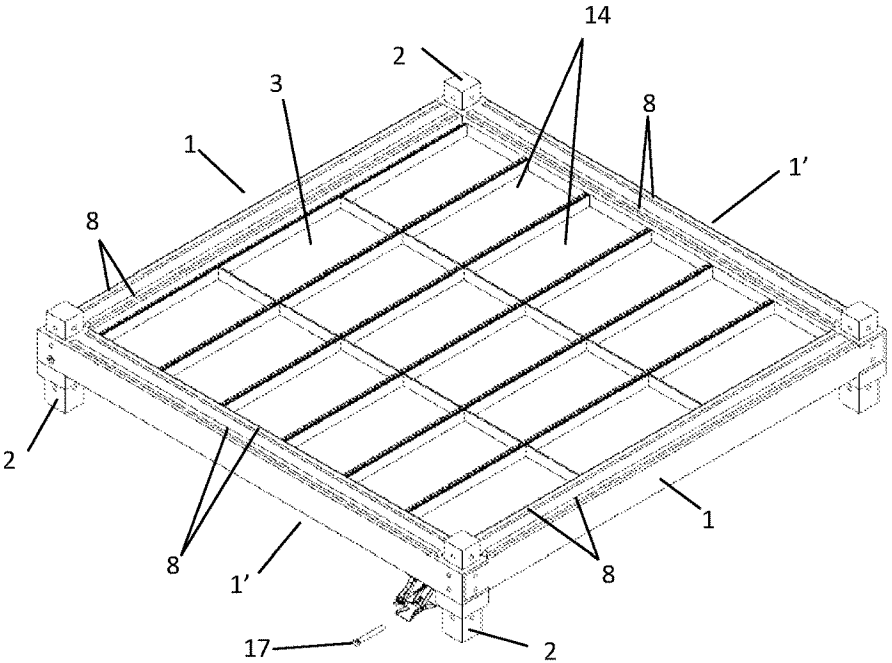
Figure 9:
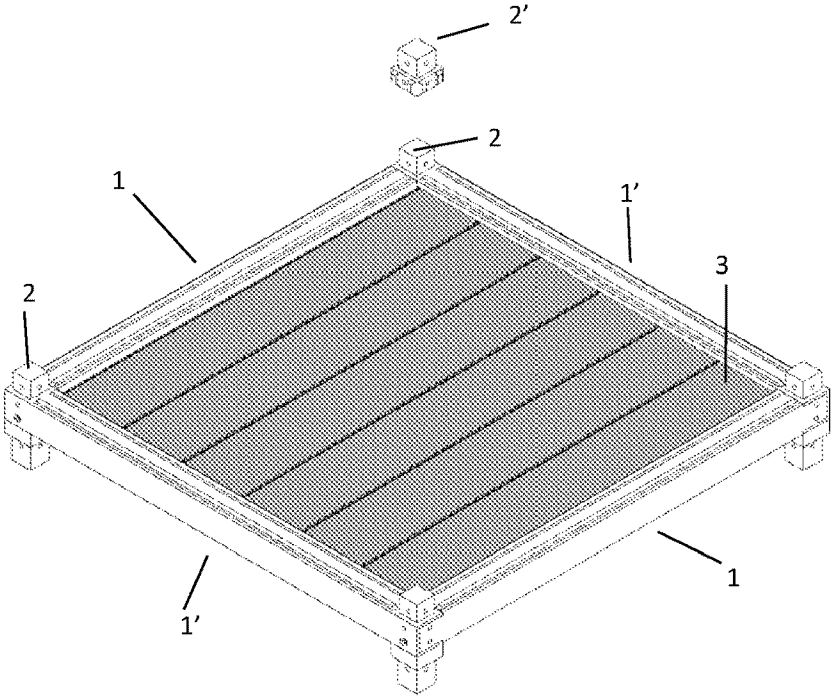
Figure 8:
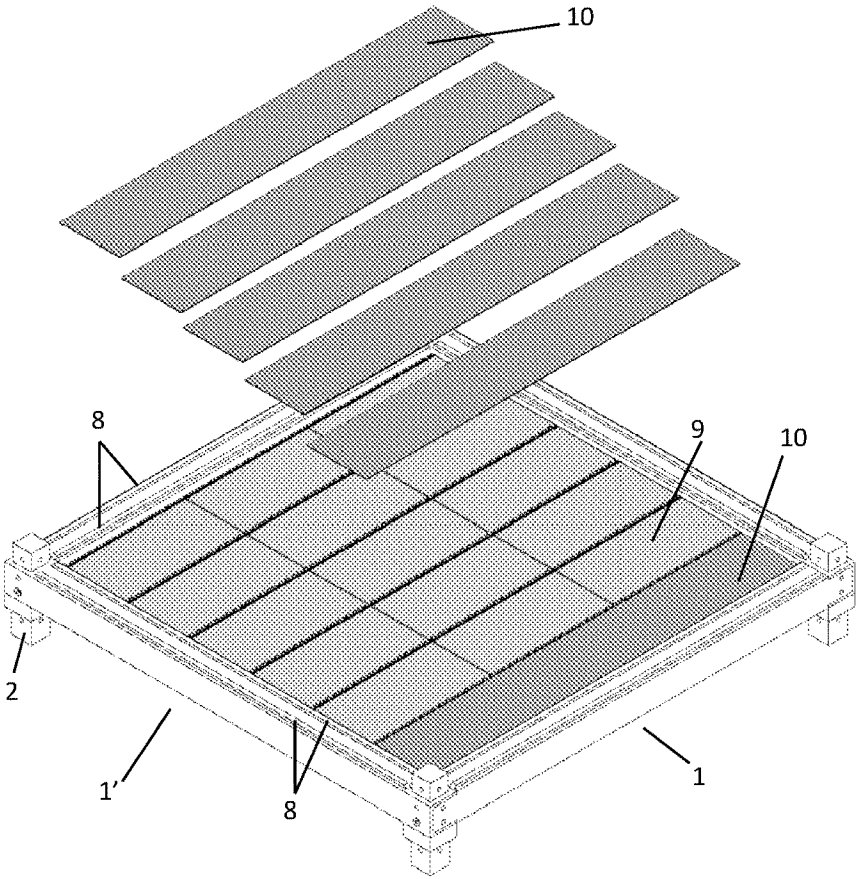
Figure 11:
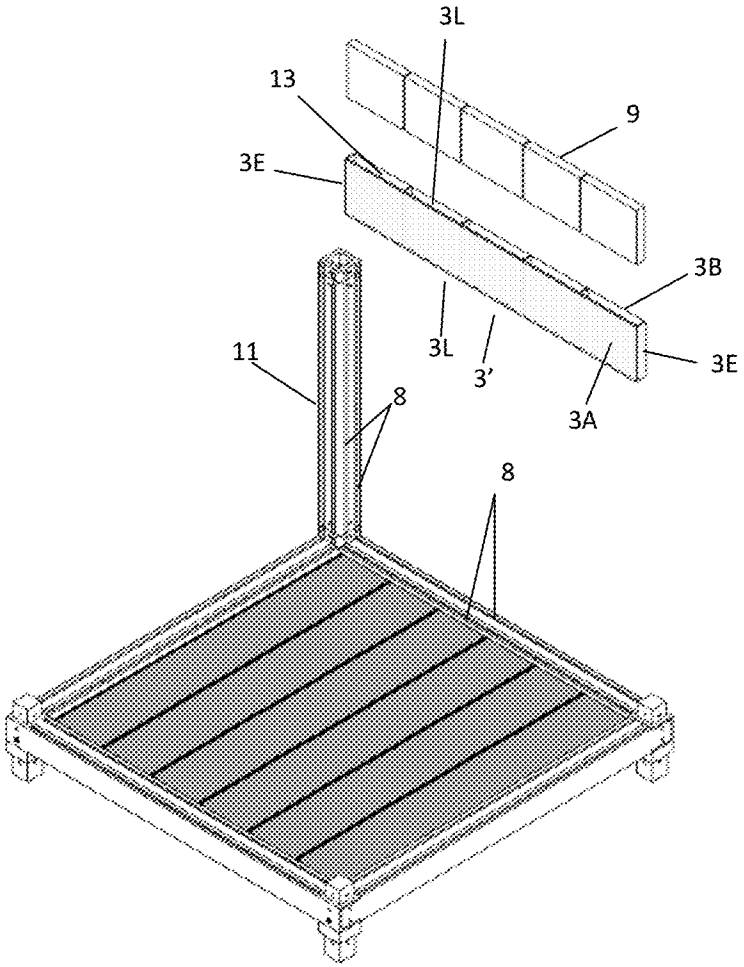
Figure 10:
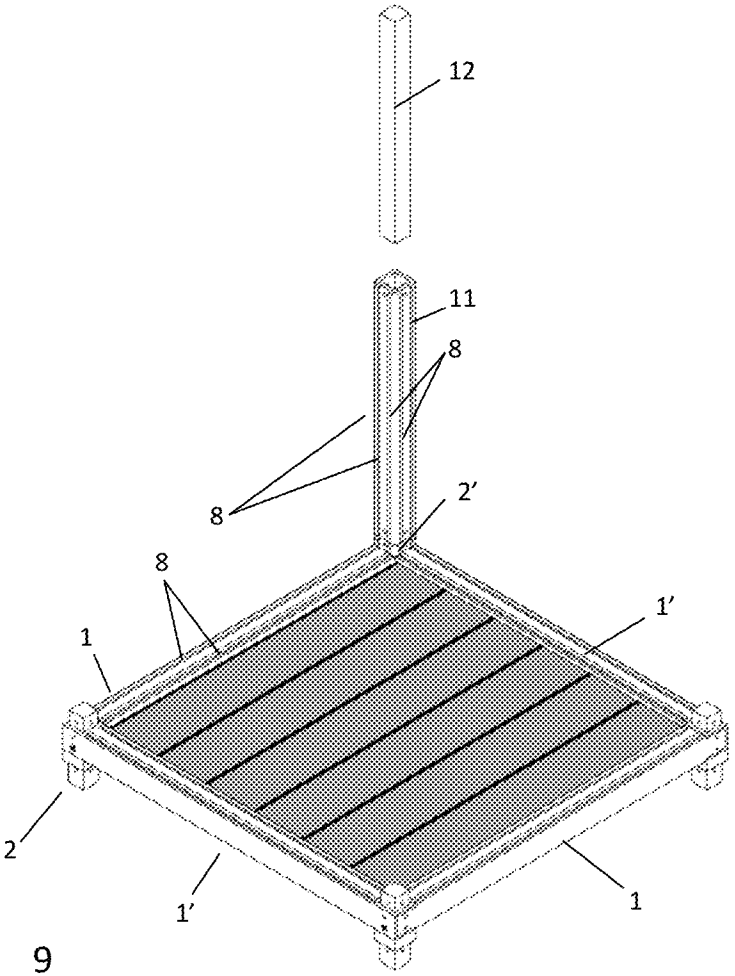
Figure 13:
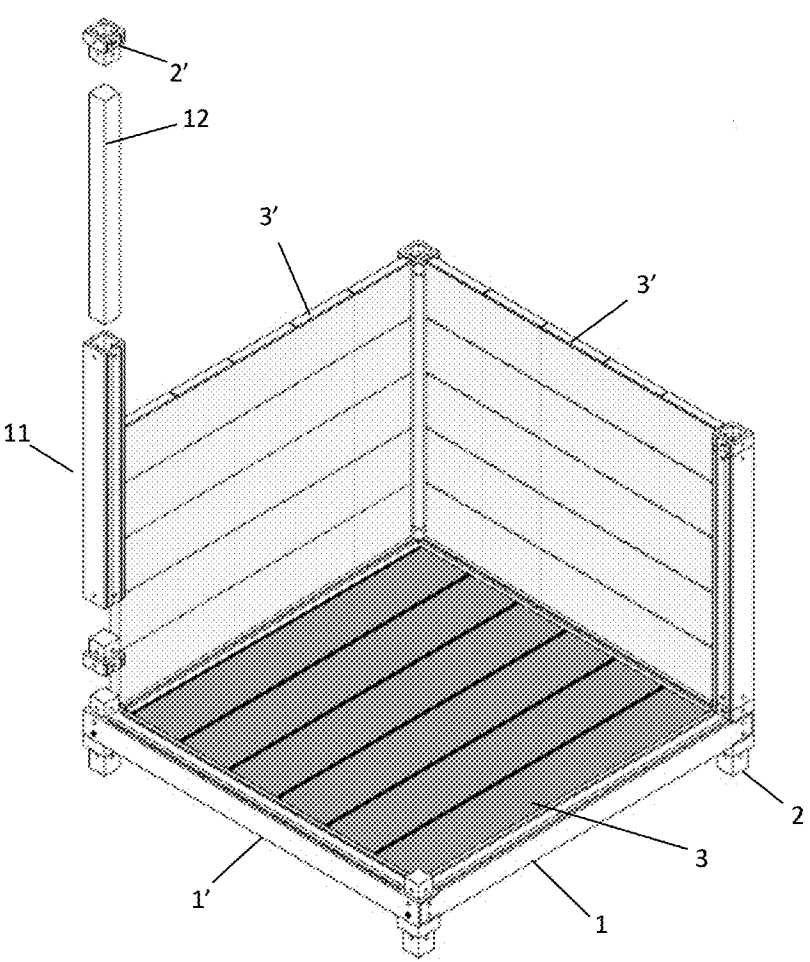
Figure 12:
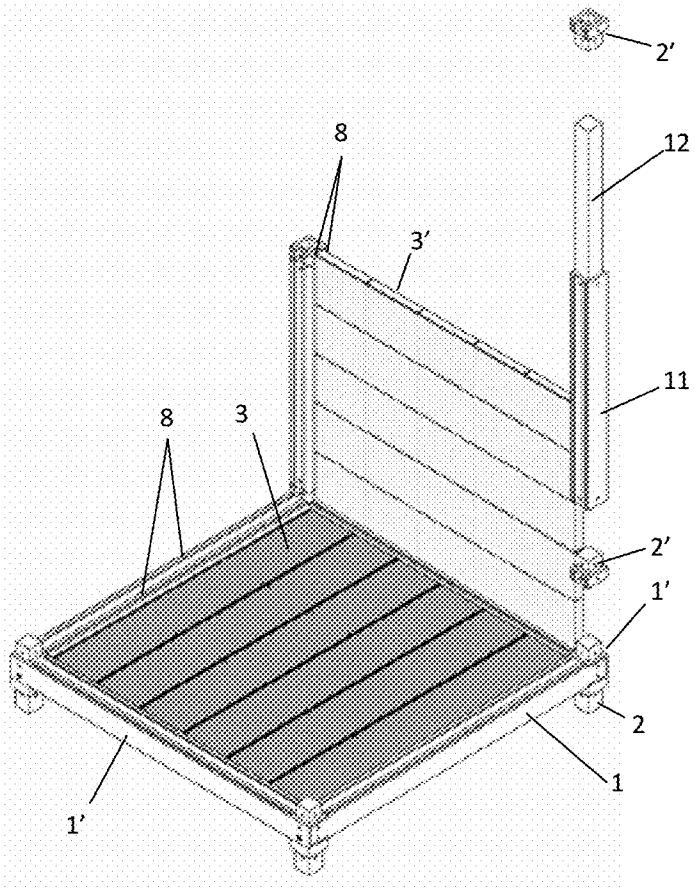
Figure 15:
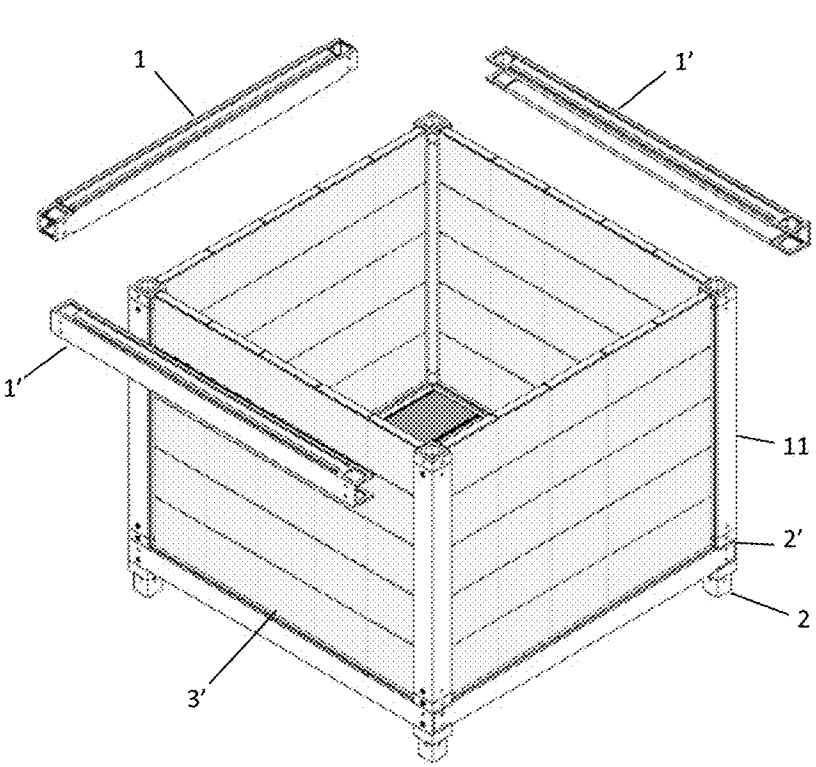
Figure 14:
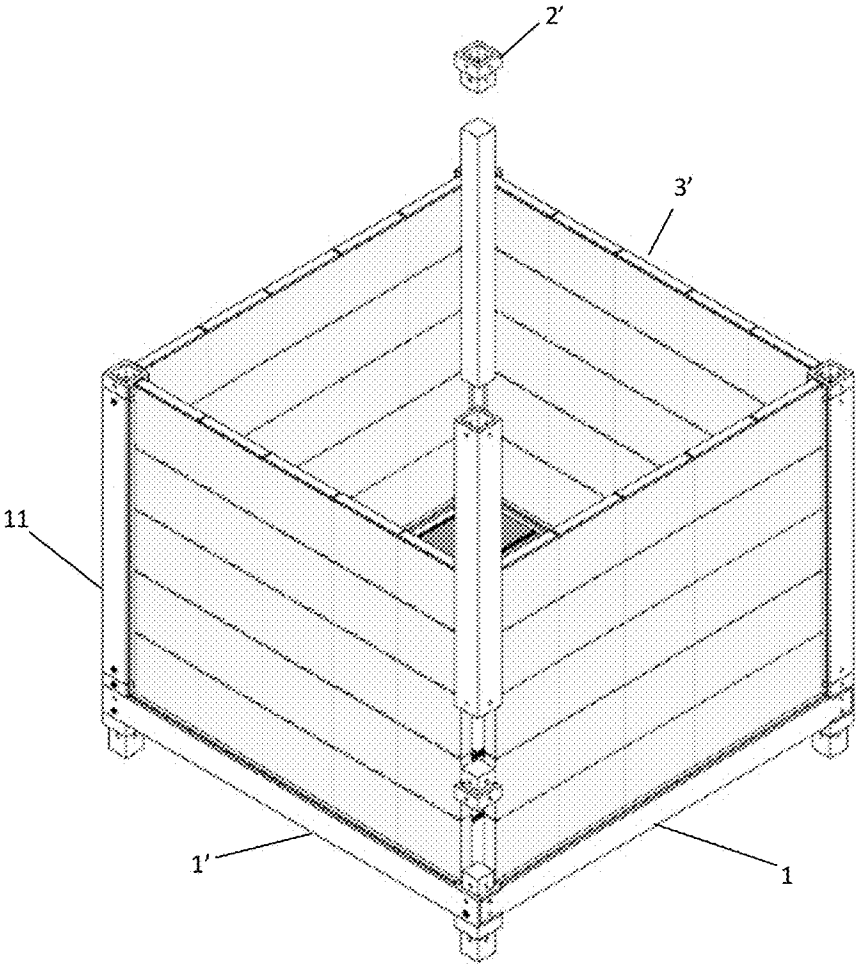
Figure 16:
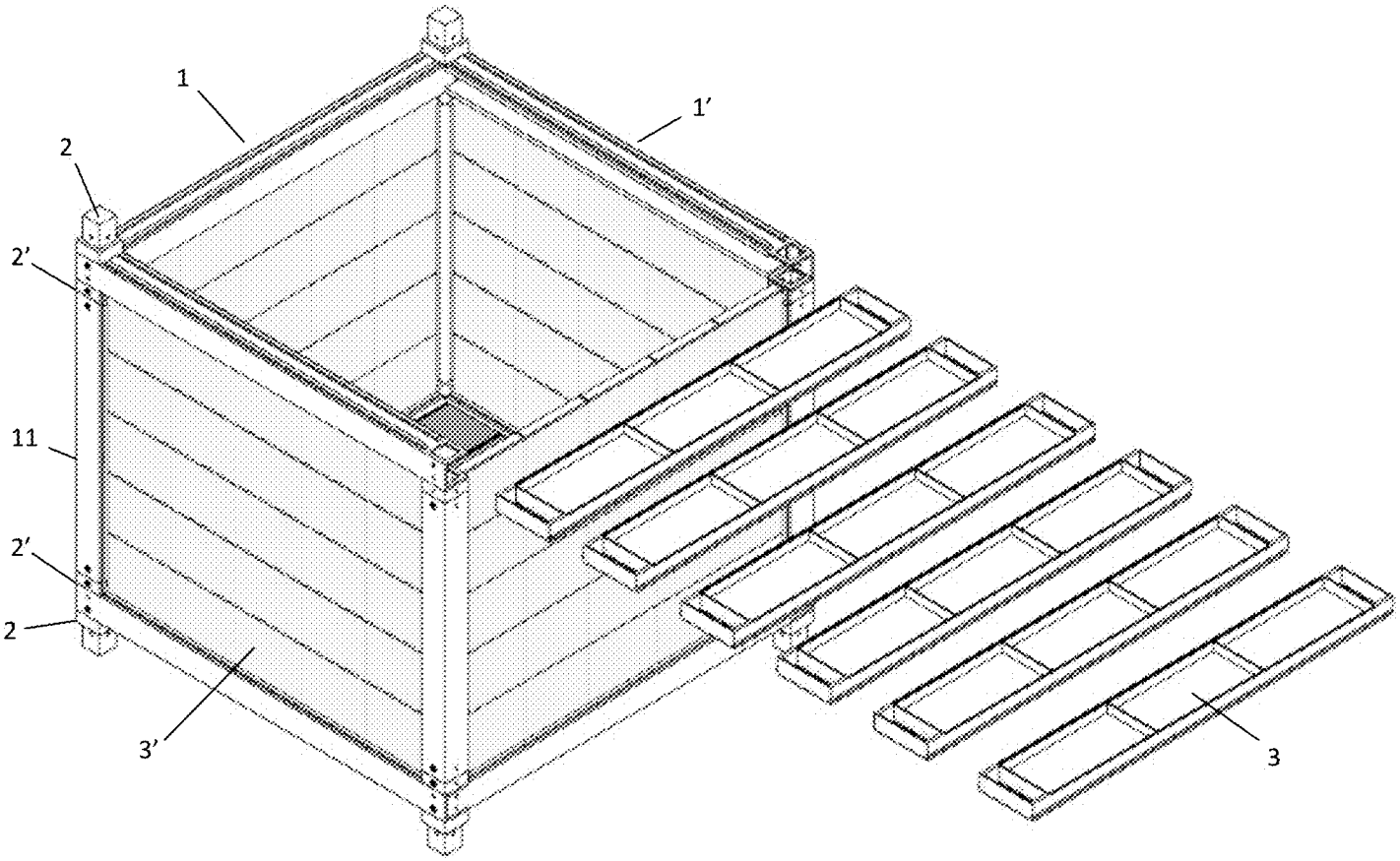
Figure 18:
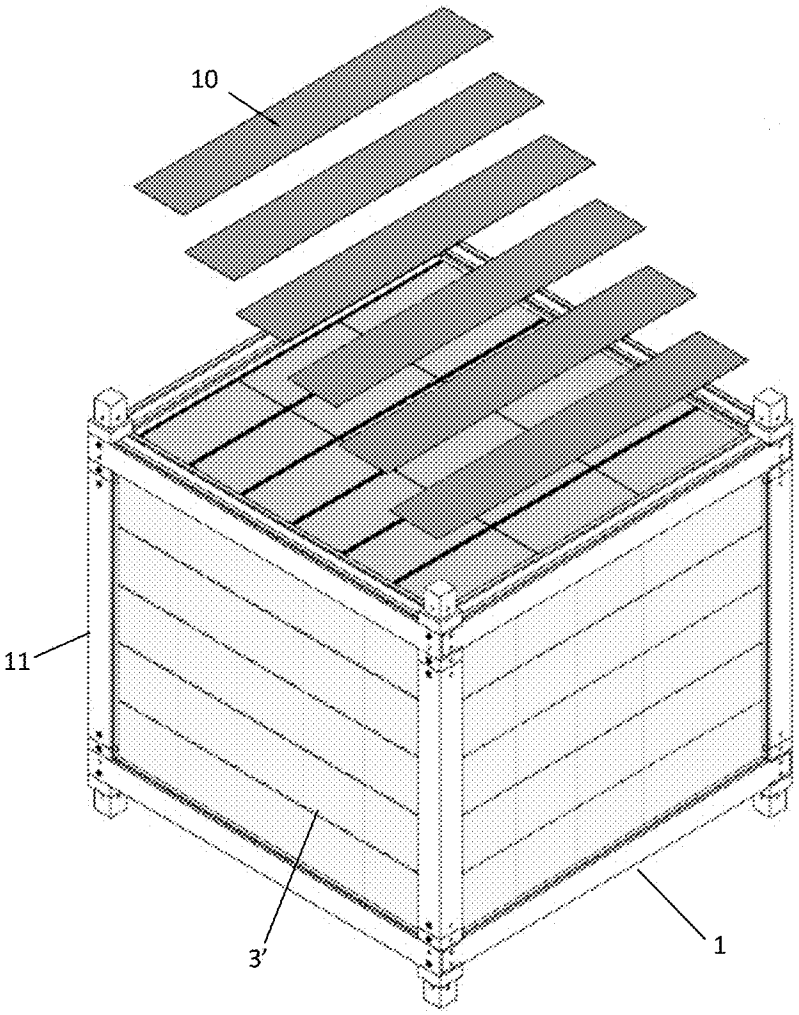
Figure 17:
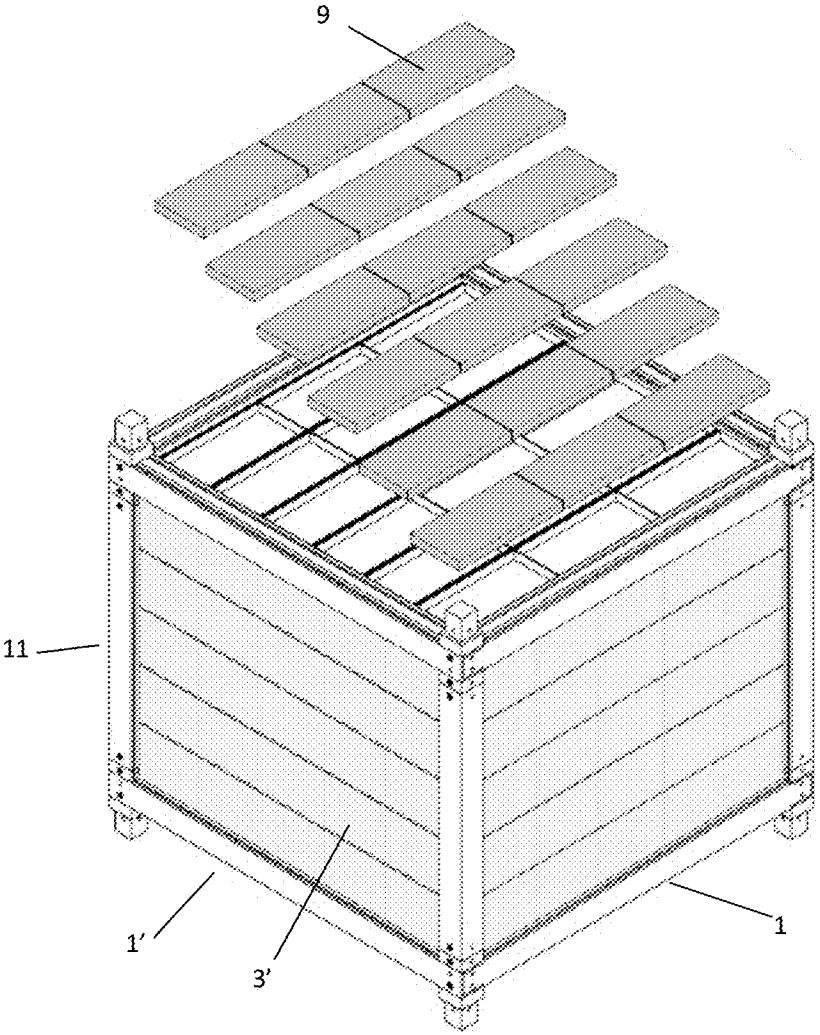
Figure 20:
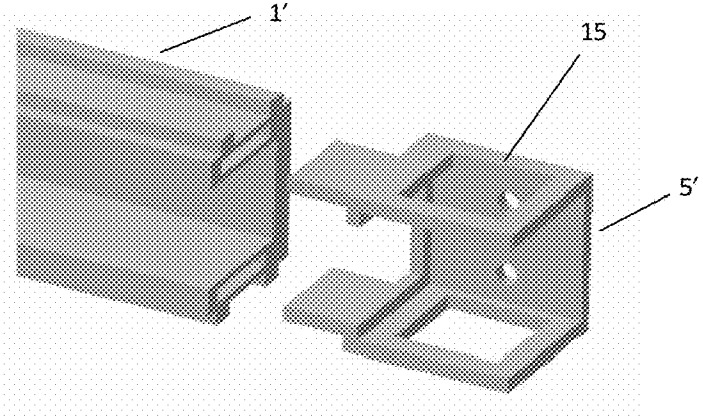
Figure 19:
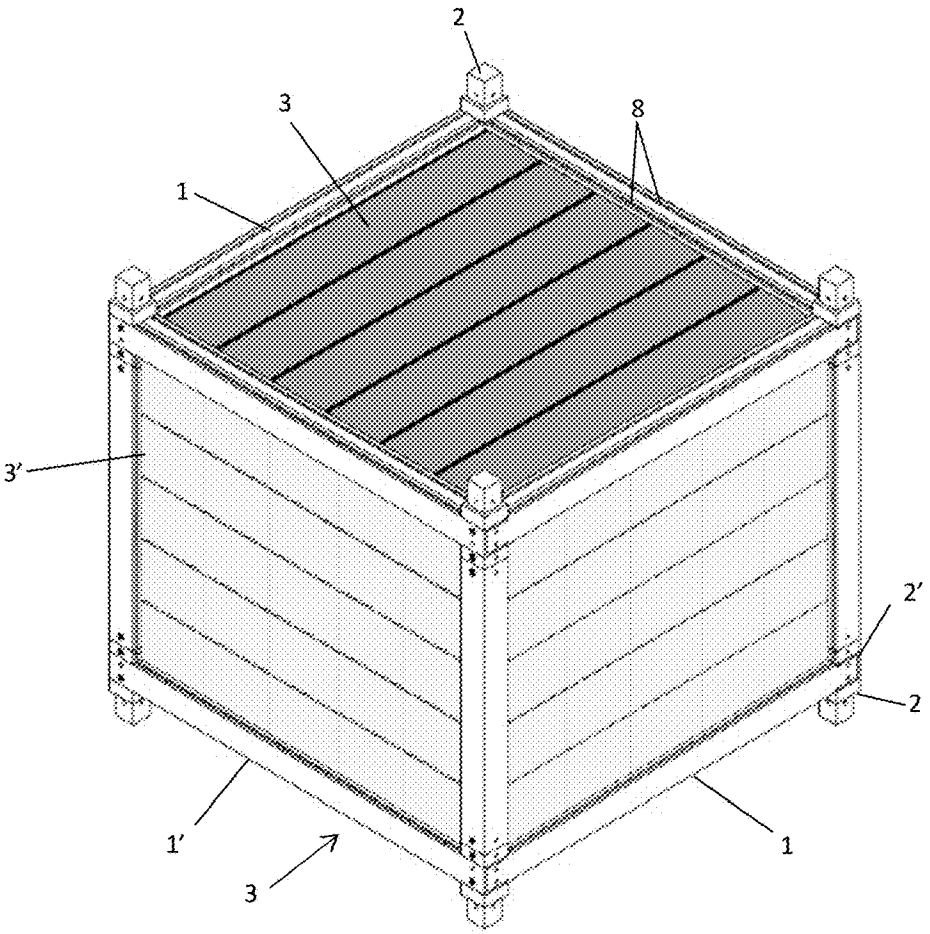
Figure 22:
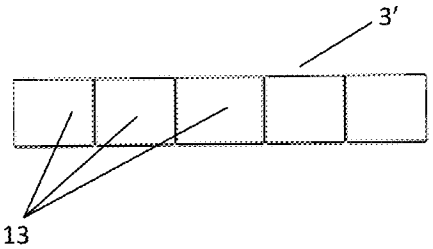
Figure 21:
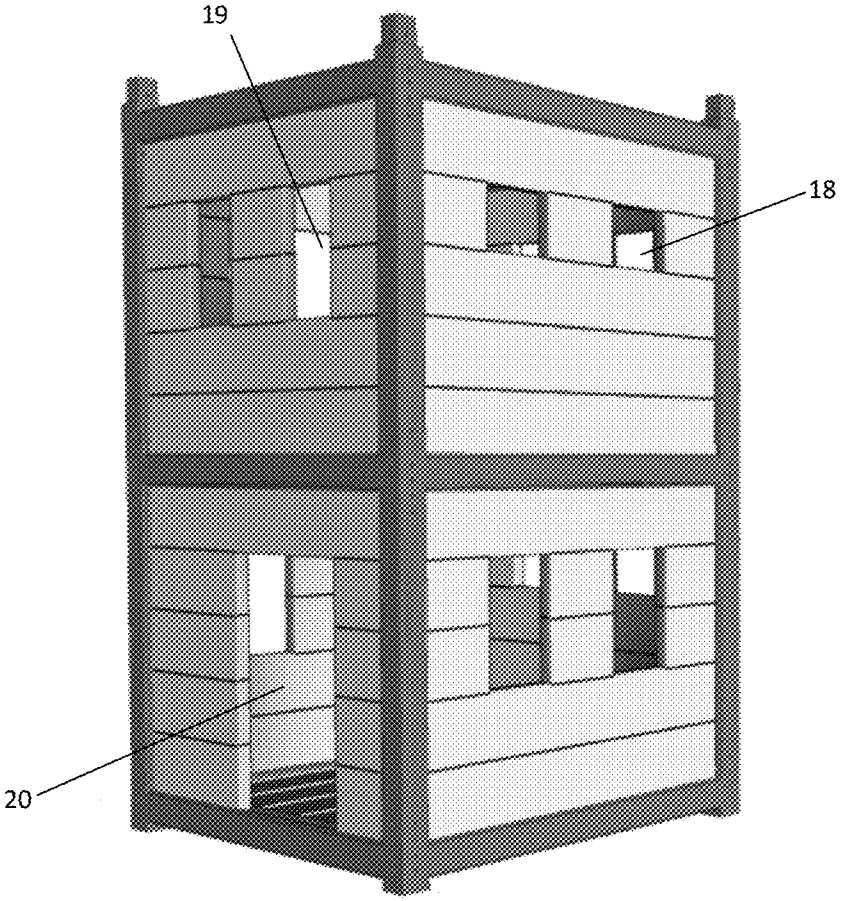

FIG. 3 represents a perspective view of a beam of type 1 and two beams of type 2 assembled by their ends and ready to receive corner assembly elements intended to pass through a transverse passage opening in the beams of type 1 and 2;

FIG. 4 represents a perspective view of a beam of type 1 and two beams of type 2 assembled by their ends and corner assembly elements passing through a transverse passage opening of the beams of type 1 and 2 so that plates are able to slide in and between the beams of type 2;

FIG. 5 represents a perspective view of the assembly of beams from FIG. 4 and six plates arranged in and between the beams of type 2 together with a beam of type 1 intended to be assembled with the two beams of type 2;

FIG. 6 represents a perspective view of the assembly of two beams of type 1 and two beams of type 2 and six plates arranged in and between the beams of type 2 and between the two beams of type 1;

FIG. 7 represents the assembly from FIG. 6 in which insulating materials are arranged in a first plate and ready to be arranged in each of the other five plates;

FIG. 8 represents the assembly from FIG. 7 in which insulating materials are arranged in each of the six plates and the covers adapted to cover each plate containing an insulating material;

FIG. 9 represents the assembly from FIG. 8 when the covers are placed completely on the plates;

FIG. 10 represents the assembly from FIG. 9 in which a hollow post is disposed at one corner of the rectangular assembly, the post being ready to receive a reinforcement;

FIG. 11 represents the assembly from FIG. 10 and other plates and insulating materials ready to be disposed in rails on the beam and on the post;

FIG. 12 represents the assembly from FIG. 11 with five other plates and a second post and its reinforcement ready to be installed;

FIG. 13 represents the assembly from FIG. 12 with a second partition of five other walls ready to be installed;

FIG. 14 represents the assembly from FIG. 13 with third and fourth partitions of five other walls and a fourth post and its reinforcement ready to be installed;

FIG. 15 represents the assembly from FIG. 14 with a beam of type 1 and two beams of type 2 disposed to be assembled together above said assembly;

FIG. 16 represents a beam of type 1 and two beams of type 2 assembled above said assembly from FIG. 15 by their ends and corner assembly elements passing through a transverse passage opening of the beams of type 1 and 2 so that six plates are able to slide in and between the beams of type 2;

FIG. 17 represents the assembly from FIG. 16 when the six plates have slid in and between the beams of type 2 and insulation materials ready to be disposed in housings in each of the six plates;

FIG. 18 represents the assembly from FIG. 17 when the insulating materials are disposed in housings in each of the six plates and covers adapted to cover each plate containing an insulating material;

FIG. 19 represents the assembly from FIG. 18 when completely assembled;

FIG. 20 represents a part of a type 2 beam in which the end consists of a metal part ready to be inserted in openings in a beam of type 2;

FIG. 21 represents two dwelling modules in accordance with the present invention superposed one on the other and provided with windows and a door;

FIG. 22 represents a view in longitudinal section of another wall; and

Figure 23:
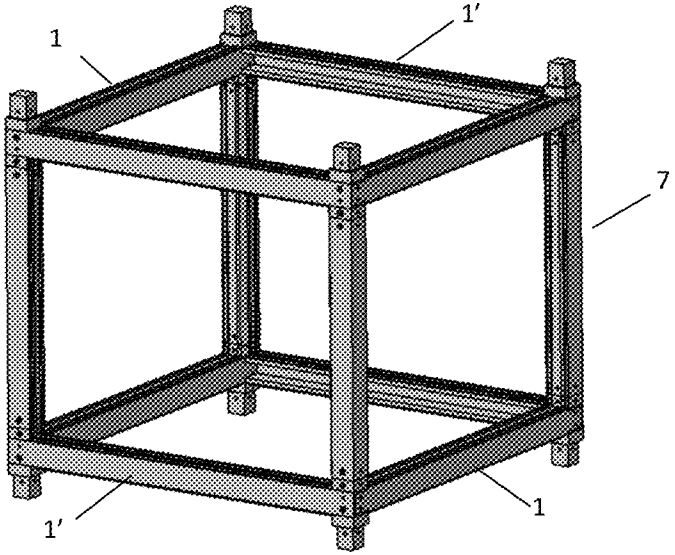

FIG. 23 represents a framework produced with the aid of beams of type 1 and type 2 and corner assembly elements.

Figure 1:
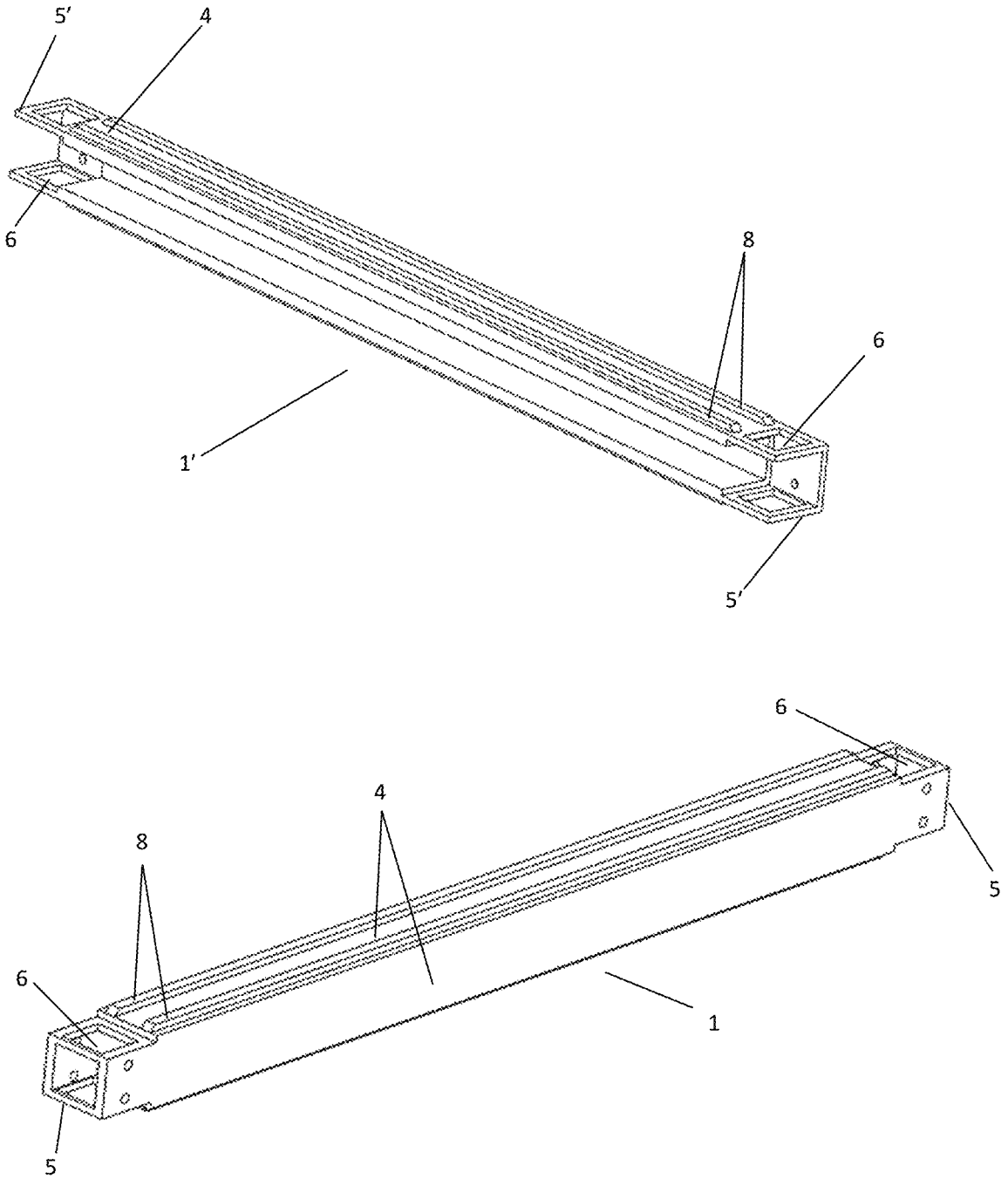
FIG. 1 represents a perspective view of two hollow profiled beams, one of type 1 and the other of type 2.
Figure 2:
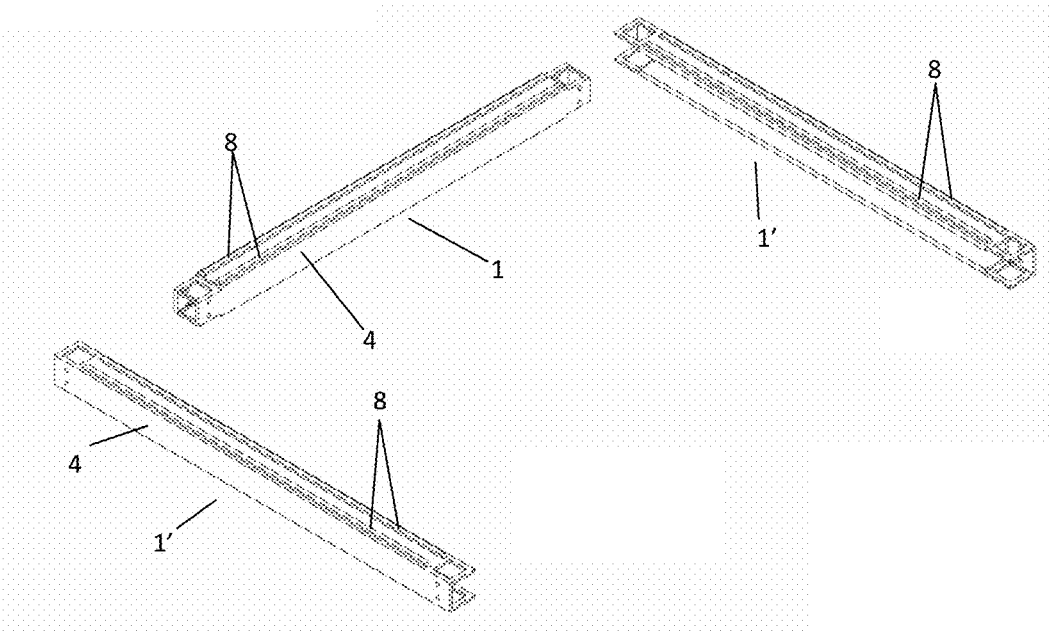
FIG. 2 represents a perspective view of a beam of type 1 and two beams of type 2 disposed to be assembled together.

A module of a dwelling as shown in FIG. 19 or FIG. 21 and the main elements of which are made of plastic material includes a set of beams 1, 1' (see FIG. 1 and FIG. 2) hollow profiled beams of elongate rectilinear shape of type 1 and type 2. The beams 1 of type 1 have a closed square section and the beams 1' of type 2 have a U-shaped section intended to receive plates 3. As shown in FIGS. 1 and 2, the beams 1, 1' include at each end 5, 5' a transverse passage opening 6, 6' such that the transverse passage opening 6 of a beam 1 of type 1 comes to nest with the transverse passage opening 6' of a beam 1' of type 2 when the two beams 1, 1' are assembled end to end at a right angle leaving a passage opening 6, 6' between the two ends 5, 5' of the beams 1, 1'. In this way, two beams 1 of type 1 may be assembled with two beams 1' of type 2 to form a rectangular frame as shown in particular in FIG. 6.

As shown in FIG. 3, two corner assembly elements 2 are adapted to pass through the transverse passage opening 6, 6' of the beams 1, 1' of type 1 and 2. The corner assembly elements include a rectangular first piece including holes to receive bolts and a retaining flange of rectangular shape that serves to support the structure when the first assembly part 2 is inserted in the transverse opening. As shown in FIG. 20, and for greater robustness, the beams 1, 1' include at each end 5, 5' a removable metal part 15.

As shown in FIG. 4, a beam 1 of type 1 and two beams 1' of type 2 are assembled by their ends 5, 5'. Two corner assembly elements 2 pass through a transverse passage opening 6, 6' of the beams 1, 1' of types 1 and 2 so that plates 3 can slide in and between the beams 1' of type 2. The corner assembly elements 2 are retained in position with the beams 1, 1' by means of bolts 17. Also, in this example, the assembly of beams 1, 1' rests on one side on the two corner assembly elements 2 and on the other side on lifting/support means 16 such as a jack. When six plates 3 are arranged in and between the beams 1' of type 2 a beam of type 1 is assembled with the two beams 1' of type 2 (see FIG. 5). Thus the set of plates 3 assembled between two beams 1 of type 1 when assembled or two beams 1' of type 2 when assembled form a rectangular frame as shown in FIG. 6.

As shown in FIG. 7, once this first rectangular structure has been assembled insulating materials 9 are arranged in housings 14 of each of the six plates 3. Thereafter covers 10 are disposed on each of the six plates 3 as shown in FIGS. 8 and 9. The corner assembly elements include a second rectangular part 2' including holes to receive bolts and a retaining flange of rectangular shape that serves to support a post. The second rectangular part 2' is hollow on one side to nest with the first part of the corner assembly element 2.

As shown in FIG. 10, when this rectangular frame formed of beams 1, 1' of type 1 and type 2 has been assembled, a corner assembly element 2' receives hollow ends of a post 11 of rectangular hollow section of a rectangular frame formed of beams 1, 1' of type 1 and type 2 so as to form a three-dimensional framework. The posts 11 include longitudinal grooves or rails 8 on two adjacent surfaces to receive other plates 3' between the posts 11 during assembly. In this example, a reinforcement 12 is inserted into the post 11 to make it more robust.

An upper surface of each beam 1, 1' and each post 11 includes spaced rails 8 intended to receive said other plates 3'. In the example shown the other plates 3' are thinner than the plates 3 but they may of course be the same size.

As shown in FIGS. 11 and 12, the other plates 3' are adapted to slide between the rails 8 of the beams 1 of type 1 and type 2 and posts 11. The other plates 3' include compartments 13 for arranging insulating elements 9. As can be seen in FIG. 11 in particular, the other plate 3' includes two opposite wide faces 3A, 3B extending between two lateral faces 3L and end faces 3E. The other plates 3' are adapted to constitute walls of said framework 7.

As shown in FIG. 12, a complete wall is assembled by assembling five other plates 3' disposed in rails 8 on the beam 1' and on the posts 11. In each of the posts 11 a reinforcement 12 serves to harden the structure.

FIGS. 13 to 19 show the various steps of constructing a dwelling module according to the present invention. The walls are assembled one after the other in accordance with the same principle as the first wall from FIG. 12 thanks to the other plates 3', the posts 11, their reinforcements 12, the corner assembly elements 2, 2' and the insulating elements. The structure serving as a ceiling is assembled in accordance with the same principle as the part on the ground thanks to the beams 1, 1', the corner assembly elements 2, the plates 3, the insulating elements 9 and the covers 10.

As shown in FIG. 19, when the corner assembly elements 2 are fixed to the ground, a construction module assembled by means of a set of beams 1, 1', a set of corner assembly elements 2, 2' and plates 3, 3' has the advantage of having the other plates 3' that resist wind loads up to 160 kg/m$^2$, the lower plates 3 that withstand ground loads up to 224 kg/m$^2$ and the upper plates 3 that withstand loads on the upper part of the module up to 107 kg/m$^2$. The module as shown measures 3 m side length and between 2.5 m height.

To be able to withstand such conditions and such loads, each beam 1, 1' weighs between 50 and 150 kg, each plate 3, 3' weighs between 40 kg and 120 kg and each corner assembly element 2, 2' weighs between 5 kg and 30 kg.

It is obvious that to be used the construction module as shown in FIG. 19 necessitates openings. The plates 3 and the other plates 3' therefore include extractable zones for creating openings.

In this example the openings in the other walls 3' are created by removing, for example by cutting or sawing, one compartment 13 of the five compartments of each of the other walls 3' as shown in FIG. 23 where there is represented a view in longitudinal section of another wall 3' with the compartments.

As shown in FIG. 21, two construction modules are stacked one on the other. In this example, when the corner assembly elements 2, 2' of the first construction module are fixed to the ground the other plates 3' resist wind loads up to 182 kg/m$^2$, the lower plates 3 withstand ground loads up to 224 kg/m$^2$ and the upper plates 3 of the second module withstand loads on the upper part of said second module up to 107 kg/m$^2$.

The top dwelling module includes four openings serving as windows. Two small windows 18 are created by cutting out two compartments of another plate 3'. Two large windows 19 are created by cutting out two compartments on two other plates 3' mounted one on top of the other. The bottom dwelling module includes a large opening 20 serving as a door and two small openings 18 serving as windows. The door 20 is created by cutting out two adjacent compartments 13 of four other plates mounted one on top of the other. In this example, even if not visible, the plates 3 common to the bottom module and the top module also include openings between the two modules. In another version not shown an outside staircase may provide access to the top dwelling module.

In another example not shown, when the corner assembly elements 2, 2' are fixed to the ground and a second construction module is coupled to a first module, via a lateral part, the other plates 3' common to the two modules are optionally mounted using a modified form of the posts 11.

For greater comfort, although until now it has been stated that the compartments 13 and the housings 14 of the plates 3, 3' enable incorporation of an insulating material, integrating electrical cables and pipes is also envisaged. The pipes may also serve as much to transport water to a water point disposed in said dwelling as to evacuate waste water to the exterior of said dwelling. In fact, the plates 3, 3' include compartments 13 and housings 14 several centimeters thick, for example a minimum of 15 centimeters, thereby enabling integration of the insulating material on the one hand and the pipes and cables on the other hand.

The upper part of the module of a dwelling is always sealed either by a particular way of mounting the plates 3, 3' or, in an example not shown, by positioning a covering to which may be applied a polymerizing resin making said covering rigid and impermeable. A structure of this kind is produced using beams and posts. Each post and beam includes holes, in particular those in which bolts are inserted, in which come to be threaded tubes having a section corresponding to the holes. These tubes are of sufficient length to constitute a structure that would project from the dwelling module sufficiently to adjust the slope of a roof or a roof overhang as a function of the geographical location of said dwelling module. Thus once this structure for the roof has been produced, one or more coverings, possibly solar panels, may be disposed and tensioned in the way that a capital is tensioned for example.

Once the covering has been tensioned and shaped it is necessary to proceed to the application of a transparent or colored resin to the interior or exterior part of the covering, for example by means of a brush or spray gun. There is then obtained after polymerization a thin but rigid and strong thin resin shell that is easily repairable.

In another version not shown the upper part of the dwelling module may be planted.

A dwelling module according to the present invention has the advantage of being easy and rapid to assemble and is so robust that it complies with the standards on supporting structures such as the standard EN1991.

In all embodiments there must be understood by plastic material any material that can be recycled (PEND, PEBD, PP, PET, PS, ABS . . . ). The recovered plastic parts are preferably able to be ground and chipped. Once chipped, the plastic is washed and then dried before being prepared for an extrusion operation. The polymers are melted by heat and a uniform paste is then obtained. Following a succession of conventional steps, a grain is obtained. The granules are then extracted from the extruder. Finally, the grains could serve for the production of the construction elements according to the present invention.

KEY

1: type 1 beam
1': type 2 beam
2, 2': corner assembly elements
3: plate
3': other plate
3A: other plate front face
3B: other plate rear face
3L: other plate lateral faces
3E: other plate end faces
4: beam lateral faces
5, 5': beam end faces
6: beam passage opening
7: framework
8: rails, grooves
9: insulation
10: cover
11: post
12: post reinforcement
13: compartment
14: housing
15: beam removable part
16: lifting means
17: bolt
18: small window
19: large window
20: door

The invention claimed is:

1. A construction system for a module of a dwelling, the construction system including:

a set of hollow profiled beams (1, 1') of elongate rectilinear shape of type 1 and of type 2, in which the hollow profiled beams (1) of type 1 have a closed square section and the hollow profiled beams (1') of type 2 have a U-shape section, wherein two hollow profiled beams (1) of type 1 are adapted to be assembled with two hollow profiled beams (1') of type 2 to form a rectangular frame when the two hollow profiled beams (1, 1') of type 1 and type 2 are assembled end to end at a right angle, the hollow profiled beams (1) of type 1 and the hollow profiled beams (1') of type 2 each including at each end (5, 5') a transverse passage opening (6, 6') as hereinafter defined such that the transverse passage opening (6) of a hollow profiled beam (1) of type 1 comes to be nested with the transverse passage opening (6') of a hollow profiled beam (1') of type 2 when the two hollow profiled beams (1, 1') of type 1 and type 2 are assembled end to end at a right angle leaving a passage opening (6, 6') between the two ends (5, 5') of the hollow profiled beams (1, 1') of type 1 and type 2 so that two hollow profiled beams (1) of type 1 can be assembled with two hollow profiled beams (1') of type 2 to form a rectangular frame, wherein the transverse passage opening (6) at each end of a hollow profiled beam of type 1 of square section has a central transverse passage opening through its square section, and wherein the transverse passage opening (6') at each end of a hollow profiled beam of type 2 of U-shaped section has facing transverse passage openings in its facing U-shaped sections, all said transverse passage openings being aligned when nested to receive a body of a corner assembly element (2, 2') for assembling a corner of the assembled rectangular frame, a set of corner assembly elements (2, 2'), each corner assembly element (2, 2') including a body adapted to pass through the transverse passage opening (6, 6') of the hollow profiled beams (1, 1') of type 1 and 2 such that said body of the corner assembly element (2, 2') projects out of the rectangular frame formed by the hollow profiled beams (1, 1') of type 1 and type 2, a set of plates (3) that can be assembled between two hollow profiled beams (1) of type 1 between two hollow profiled beams (1') of type 2, when the two beams (1) of type 1 and the two beams (1') of type 2 are assembled to form a rectangular frame, and a set of posts (11) of hollow rectangular section the hollow ends of which come to be nested over a corner assembly element (2, 2') of a rectangular frame formed of hollow profiled beams (1) of type 1 and of hollow profiled beams (1') of type 2 so as to form a three-dimensional framework, the posts (11) include longitudinal rails or grooves (8) on two adjacent surfaces to receive other plates (3') between the posts (11) during assembly, the hollow profiled beams (1, 1') of type 1 and type 2 each including along an upper surface spaced rails or grooves (8) adapted to receive said other plates (3'), wherein the hollow profiled beams (1, 1') of type 1 and of type 2, the corner assembly elements (2, 2'), the plates (3) and the posts (11) are all made of plastic material.

2. The construction system as claimed in claim 1, in which the hollow profiled beams (1) of type 1 of closed square section, and the hollow profiled beams (1') of type 2 of U-shape section are adapted to receive said plates (3).

3. The construction system as claimed in claim 1, in which construction module is adapted to be assembled with another construction module, each construction module measuring between 2.5 m and 3.5 m side length and between 2.2 m and 2.8 m high.

4. The construction system as claimed in claim 1, in which the plates (3) and the other plates (3') include extractable zones for creating openings.

5. The construction system as claimed in claim 1, in which the plates (3, 3') are adapted to slide in the hollow profiled beams (1') of type 2 and between the grooves or the rails (8) of the hollow profiled beams (1) of type 1 and the posts (11).

6. The construction system as claimed in claim 1, in which the other plates (3') include compartments (13) for insulation elements (9) and the plates (3) include opposite wide faces (3A, 3B) and a housing (14) on one of the wide face (3A, 3B) for insulation elements (9), the housing (14) being closable by a sealed cover (10).

7. The construction system as claimed in claim 1, in which the hollow profiled beams (1, 1') of type 1 or type 2 include at each end (5, 5') a removable part (15) made of a more rigid material than the hollow profiled beams (1, 1' of type 1 or type 2.

8. The construction system as claimed in claim 1, in which each hollow profiled beam (1, 1') of type 1 or type 2 weighs between 50 and 150 kg, each plate (3, 3') weighs between 40 kg and 120 kg and each corner assembly element (2, 2') weighs between 5 kg and 30 kg.

9. The construction system as claimed in claim 1, in which the construction system is made from recycled plastic materials.

10. The construction system as claimed in claim 1, in which each hollow profiled beam (1, 1') of type 1 or type 2 and each plate (3, 3') is filled with a substance for hardening its structure.

11. An assembly of a habitation module constructed from a construction system as claimed in claim 1, including a three-dimensional framework assembled from said hollow profiled beams (1) of type 1 and said hollow profiled beams (1') of type 2 forming horizontal rectangular frames and said posts (11) disposed vertically and assembled to the corners of the rectangular frames, said plates (3) disposed horizontally between the hollow profiled beams of type 1 and type 2, and other plates (3') disposed vertically between said posts (11) and superposed on said hollow profiled beams (1, 1') of type 1 or type 2.

12. An assembly as claimed in claim 11 of a construction module by means of a set of said hollow profiled beams (1, 1') of type 1 or type 2, a set of said corner assembly elements (2, 2') and plates (3, 3') as claimed in claim 1, characterized in that when the corner assembly elements (2, 2') are fixed to the ground, the other plates (3') resist a wind load up to 160 kg/m$^2$, the plates (3) in a lower part of the construction module withstand ground loads up to 224 kg/m$^2$ and the plates (3) in an upper part of the construction module withstand loads on the upper part of the module up to 107 kg/m$^2$.

13. The assembly as claimed in claim 11, in which when the corner assembly elements (2, 2') are fixed to the ground a second construction module may be coupled to a first construction module.

14. An assembly according to claim 13 of two superposed construction modules, a second construction module being arranged on a first construction module, the corner assembly elements (2, 2') of the first construction modules being fixed to the ground, the other plates (3') resisting a wind load up to 182 kg/m$^2$, the plates (3) in a lower part of the construction module withstanding ground loads up to 224 kg/m$^2$ and the plates (3) in an upper part of the second construction module withstand loads on the upper part of said second module up to 107 kg/m$^2$.

15. The assembly as claimed in claim 13, in which each hollow profiled beam (1, 1') of type 1 or type 2 has a removable metal end (5, 5').

16. The assembly as claimed in claim 12, in which an upper part of the module of a dwelling is sealed either by mounting plates (3, 3') or by positioning a covering to which may be applied a polymerizing resin rendering said covering rigid and impermeable.

17. The assembly as claimed in claim 12 constituting an element of a dwelling.

* * * * *